US006059139A

United States Patent [19]

Landreneau

[11] Patent Number: 6,059,139

[45] Date of Patent: May 9, 2000

[54] CONTAINER BOTTOM CONFIGURATION FOR IMPROVED SUBMERSIBILITY IN ICE

[76] Inventor: Randall L. Landreneau, 1138 Riverbend Club Dr., Atlanta, Ga. 30339

[21] Appl. No.: 08/621,150

[22] Filed: Mar. 21, 1996

[51] Int. Cl.[7] ..... B65D 1/02

[52] U.S. Cl. ..... 220/608; 215/375

[58] Field of Search ..... 220/608, 623, 220/630, 632; 215/372, 373, 374, 375, 376, 377; 407/53, 54, 58, 62

[56] References Cited

U.S. PATENT DOCUMENTS

| | | | |
|---|---|---|---|
| 385,325 | 6/1888 | Shimer | 407/53 X |
| 2,847,144 | 8/1958 | Cornelius | 220/632 |
| 3,165,813 | 1/1965 | Harvell et al. | 407/53 X |
| 3,871,541 | 3/1975 | Adomaitis | 215/375 |
| 4,867,323 | 9/1989 | Powers | 215/375 |
| 4,963,059 | 10/1990 | Hiyama | 407/62 X |
| 4,993,566 | 2/1991 | Eberle | 215/373 |
| 4,993,567 | 2/1991 | Eberle, Jr. | 215/373 |
| 5,024,339 | 6/1991 | Riemer | 215/375 |
| 5,133,468 | 7/1992 | Brunson et al. | 215/375 |

*Primary Examiner*—Steven M. Pollard
*Attorney, Agent, or Firm*—Ronald E. Smith

[57] ABSTRACT

A functional configuration for the bottom of containers and other objects needing the characteristic of being able to stand upright on a horizontal surface that facilitates their submersion into ice and other particles. This invention is comprised of a number of arc shaped arms (10) that start at the center of the bottom of a container or other object and extend outward to the edge. The arms (10) have a top surface that is parallel to a horizontal plane. There is a cutaway portion for particle dispersal (16) that is formed by the meeting of the surfaces that extend from the concave (12) and convex sides (14) of adjacent arms. The surface extending from the convex side of an arm (14) is set at an angle to the horizontal plane that is greater than the surface extending from the concave side (12) of the adjacent arm. This creates a ridge along the convex side of each arm and a cutaway portion for particle dispersal (16) that starts near the center of the bottom of a container and extends outward to the edge of the container getting wider and deeper as it moves outward. The user simply presses the bottom of the container into the ice or other particles that the container is to be submerged into and rotates it. The invention will dig a hole for itself.

5 Claims, 1 Drawing Sheet

CONTAINER BOTTOM CONFIGURATION FOR IMPROVED SUBMERSIBILITY IN ICE

BACKGROUND OF THE INVENTION

1. Field of Invention

This invention relates to the functional configuration of the bottom of containers or other objects that causes them to be easily submersible by the user into ice or other particles.

2. Description of Prior Art

A typical container of liquids such as a soft drink bottle needs to be able to stand up by itself on a horizontal surface when not in the hand(s) of a user. For this reason, typical containers of liquids have relatively flat bottoms. Consider the bottom design of typical two liter and smaller plastic bottles and cans.

The problem arises when trying to submerge such a container into an ice chest full of ice and possibly other items. The flatness of the bottom of the typical container makes it difficult to push such a container into a full ice chest. The user ends up having to scoop out an area of ice, place the container in the indention created, and fill back in the ice. This process is time consuming and cumbersome. This inventor has not found any prior art that addresses this problem.

SUMMARY OF THE INVENTION

The novel device of this invention facilitates introduction of an elongate first object having a solid outer wall into a second particulate object when the first object is rotated about its longitudinal axis. It includes a base member, a plurality of spiral arms formed into the base member, and a plurality of recesses formed into the base member. Each spiral arm is separated from a contiguous spiral arm by a recess.

Each of the spiral arms and each of the recesses emanate outwardly, in a radial but curved manner, from a flat central point that is positioned at a center of the base member; the flat central point has an area that is small in relation to an area of the base member. Each of the recesses increases in depth and breadth as they extend away from the flat central point. Thus, rotation of the object having a solid outer wall about its longitudinal axis displaces the particulate matter in a spiral-shaped, radially outwardly direction relative to the flat central point, thereby forming a bore in the particulate matter into which the object having a solid outer wall is introduced.

Objects and Advantages

Accordingly, several objects and advantages of the present invention are to provide a bottom configuration for containers and other objects that will enable them to stand upright on a horizontal surface but will also enable the user to submerge them easily and effectively into a mass of ice particles and/or other items. Further objects and advantages of my invention will become apparent from a consideration of the drawings and ensuing description.

DRAWING FIGURES

Figure 1:
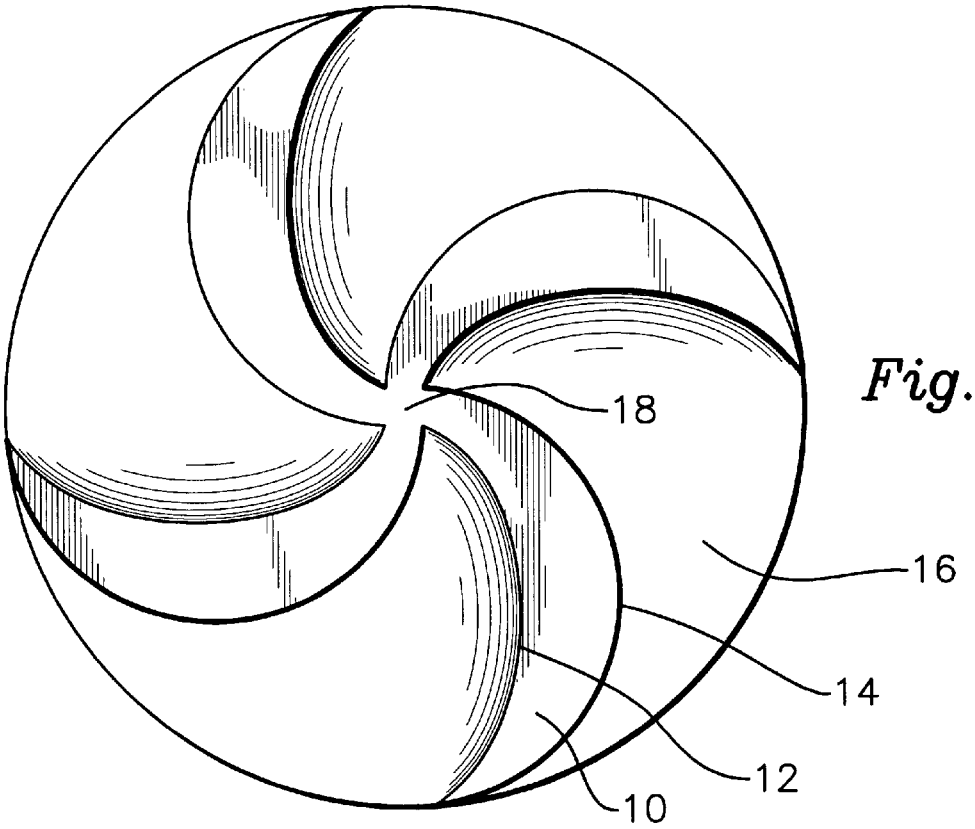
Figure 2:
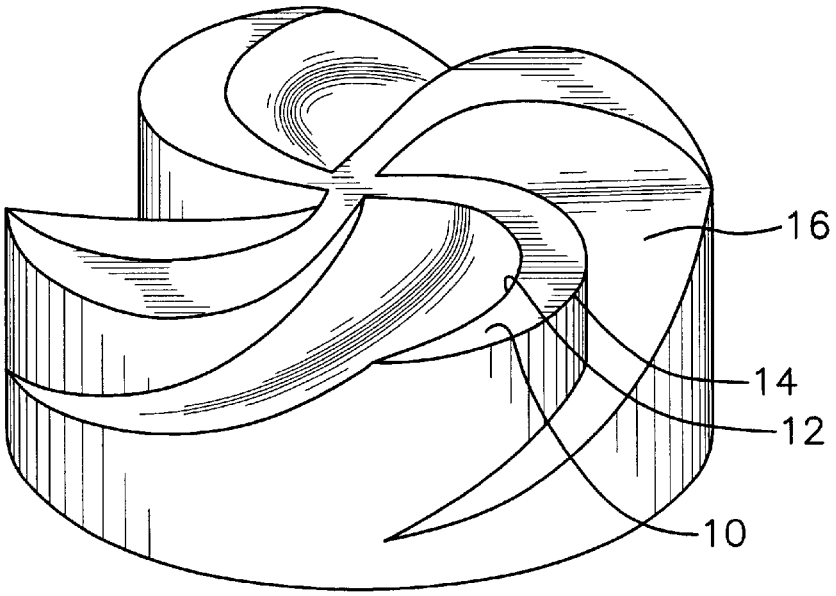

FIG. 1 shows a top view of the invention. FIG. 2 shows a three dimensional view of the invention.

| Reference Numerals In Drawings | | | |
|---|---|---|---|
| 10 | arm | 12 | concave side of arm |
| 14 | convex side of arm | 16 | cutaway portion for particle dispersal |

DESCRIPTION OF—FIGS. 1 TO 2

A typical embodiment of the present invention is illustrated in FIGS. 1 and 2. The embodiment shown in these figures could be located on the bottom of a container for liquids or other objects. This invention would either be molded onto and part of or attached to the container or other object.

There are four arc shaped arms 10 that that all have a common starting point at the center of the bottom of a container and extend outward to the edge of the container. Each arm 10 has a top surface that is parallel to a horizontal plane. Each arm 10 has a concave side 12 and a convex side 14. Between one arm 10 and another is a cutaway portion for particle dispersal 16.

Cutaway portion for particle dispersal 16 is formed by the angle of the surfaces extending from the concave side of one arm and the convex side of the arm adjacent to it. Extending from concave side of arm 12 is a surface that is at an angle of less than ninety degrees to a horizontal plane. Extending from convex side of arm 14 is a surface that is at approximately a ninety degree angle to a horizontal plane. Between two adjacent arms, these surfaces meet to form cutaway portion for particle dispersal 16. The relatively sharp angle of the surfaces extending from each convex side of arm 14 causes a ridge to occur. Each cutaway portion for particle dispersal 16 starts near the center of the bottom of the container and increases in width and depth as it goes outward to the edge of the container.

The novel structure includes a plurality of spiral arms 10 and a plurality of recesses 16 emanating from a central point 18. Significantly, although central point 18 is flat, it occupies a very small area relative to the area of the leading surface of the novel structure so that no large flat surface is presented to the particulate matter into which the novel structure is introduced. Thus, small central point 18 presents very low resistance to advancement when the novel structure is rotationally advanced into a particulate material such as ice in an icechest. Similarly, the relatively thin structure of each spiral arm also presents very little flat area as well. The depth of each recess is relatively shallow at its respective radially innermost end, i.e. adjacent central point 18, but increases as it extends in a curved radial outward direction relative to said central point; the breadth of each recess increases as well in said direction. Accordingly, a relatively small volume of ice or other particulate material is initially introduced into each recess at its radially innermost end. However, as rotation of the spiral arms continues, a progressively larger volume of ice enters into said recesses as the distance from center point 18 increases. Significantly, the ice collected in said recess areas is discharged radially outwardly of said recessed areas as the novel structure is rotated. Thus, a clockwise or counterclockwise rotation, depending upon which way spiral arms 10 are swept, bores a passageway into which the novel structure easily enters.

Operation

The flat surfaces on the top of each arm 10 enable the container to stand upright on a horizontal surface. To submerge the container into a mass of ice or other particles, the user simply presses the bottom of the container into the particles while rotating the container clockwise. As the container is rotated, the ridge along each convex side of arm 14 will come into contact with the particles and will start to move them. The particles will be caught within the cutaway portion for particle dispersal 16. The increase in width and depth from the center outward in the cutaway portion for particle dispersal 16 and the pressure and movement created by the rotation causes the caught particles to be moved outward from the center of the container and to disperse around the edge of the container. In this fashion, the container will dig a hole for itself into the particles that it is being submerged into. This operation is very simple and requires only one hand in most uses.

Summary, Ramifications, and Scope

Accordingly, the reader will see that the present invention will enable the user to submerge containers and other items easily into masses of ice and other particles. In addition, containers with the present invention will easily stand up on horizontal surfaces.

Although the description above contains many specificities, these should not be construed as limitations on the scope of the invention. For instance, rather than the four arms that are shown and described, this invention could be produced and be effective with more or fewer arms. Also, while the arms are shown with an arc direction which requires a clockwise rotation for operation, they could be reversed for a counterclockwise rotation. Also, the arms do not have to have the flat horizontal top surfaces to enable a container to stand upright. As long as the arms have a surface that is sufficiently level with a horizontal plane, the container will stand upright on a horizontal surface. In fact, the top surface of each arm could simply be the point where the concave and convex sides of an arm meet. Also, rather than the gradual downward slope of the cutaway portion from the center to the edge of the container, the cutaway portion could also have a horizontal surface some vertical distance from the top surface of the arms. Regarding the angle of the surfaces extending from the convex sides of the arms, a ninety degree angle to a horizontal plane is shown. This angle could be less than ninety degrees and still have the effect of moving particles upon rotation. Also, this angle could be greater than ninety degrees, causing the convex side of each arm to dig more into the particles they come into contact with. While a cylindrical container is shown, this invention would work as well on containers of all shapes. In addition, while this description involves a container to be submerged into ice and other particles, this invention would be effective in any situation where a an object that needs the characteristic of being able to stand upright on a horizontal surface also needs to be submerged or submergible into some form of mass.

I claim:

1. A device that facilitates introduction of an elongate beverage container having a solid outer wall into a second particulate object, such as a plurality of ice cubes comprising:

a base member;

a plurality of spiral arms formed into said base member;

a plurality of recesses formed into said base member, each spiral arm of said plurality of spiral arms being separated from a contiguous spiral arm by a recess of predetermined configuration;.

each of said spiral arms and each of said recesses emanating in a radially outwardly curved direction from a flat central point, said flat central point being positioned at a center of said base member, and said flat central point having an area that is small in relation to an area of said base member; and each of said recesses increasing in depth and breadth as said recesses extend away from said flat central point; wherein said base member is associated with the bottom of said beverage container;

whereby rotation of said beverage container about its longitudinal axis, accompanied by simultaneous advancing of said beverage container into said second object, displaces said particulate matter in a spiral-shaped, radially outwardly direction relative to said central point, thereby forming a bore in said particulate matter into which said beverage container is introduced.

2. The device of claim 1, wherein said base member is integrally formed with said beverage container.

3. The device of claim 1, wherein said base member is attached to said beverage container.

4. The device of claim 1, wherein said spiral arms and recesses are configured to facilitate clockwise rotation of said beverage container.

5. The device of claim 1, wherein said spiral arms and recesses are configured to facilitate counterclockwise rotation of said beverage container.

* * * * *